US005224709A

United States Patent [19]

Buck, Jr.

[11] Patent Number: 5,224,709

[45] Date of Patent: Jul. 6, 1993

[54] GOLF APPARATUS FOR CORRECTING A GOLFER'S SLICE

[75] Inventor: Marvin C. Buck, Jr., Cramerton, N.C.

[73] Assignee: MCB Enterprises, Inc., Cramerton, N.C.

[21] Appl. No.: 940,503

[22] Filed: Sep. 4, 1992

[51] Int. Cl.[5] ..... A63B 69/36

[52] U.S. Cl. ..... 273/186.1; 273/187 R; 273/191 R; 273/195 R

[58] Field of Search ..... 273/186.1, 191 R, 191 A, 273/191 B, 192, 187.1, 187.6

[56] References Cited

U.S. PATENT DOCUMENTS

| | | | |
|---|---|---|---|
| 720,406 | 2/1903 | Clifford | 273/186.1 |
| 1,383,876 | 7/1921 | Sullivan | 273/186.1 |
| 1,532,984 | 4/1925 | Borthwick | 273/186.1 |
| 1,596,919 | 8/1926 | Burgoyne et al. | 273/186.1 |
| 3,018,109 | 1/1962 | Starck | 273/186.1 |
| 3,113,780 | 12/1963 | Livingstone | 273/186.1 |
| 3,408,076 | 10/1968 | Carboni | 273/186.1 |
| 3,550,946 | 12/1970 | Menendez | 273/186.1 |
| 3,753,563 | 8/1973 | Previte | 273/186.1 |
| 3,994,501 | 11/1976 | O'Donnell | 273/187.1 |
| 4,465,281 | 8/1984 | Whitfield | 273/186.1 |
| 4,889,341 | 12/1989 | Walker | 273/176 F |

FOREIGN PATENT DOCUMENTS

| | | | |
|---|---|---|---|
| 2614544 | 4/1987 | France | 273/186.1 |
| 504154 | 4/1939 | United Kingdom | 273/186.1 |
| 2066083 | 7/1981 | United Kingdom . | |

OTHER PUBLICATIONS

How to Draw What You See "Project 2-Eye Level: Foundation of Perspective" Author Rudy De Reyna Copyright ©1972 by Watson-Guptill Publications.

Golf Day Catalog Edition 106B.

Florida Golf Warehouse, Summer of 1991 Edition.

*Primary Examiner*—George J. Marlo

*Attorney, Agent, or Firm*—Bell, Seltzer, Park & Gibson

[57] ABSTRACT

The golf apparatus for correcting a golfer's slice when hitting a golf ball has a tee for mounting a golf ball thereon adjacent the ground and a swing guide wall about a foot high vertically oriented with respect to the ground when the golf apparatus is in use. The swing guide is angularly adjustable and pivotable with respect to the ground and to the tee for guiding a golfer's swing so as to correct the golfer's tendency to slice the golf ball. A spring is associated with the pivotable swing guide for biasing the swing guide toward its vertically oriented position even if the swing guide is struck and pivoted by a golf club.

14 Claims, 2 Drawing Sheets

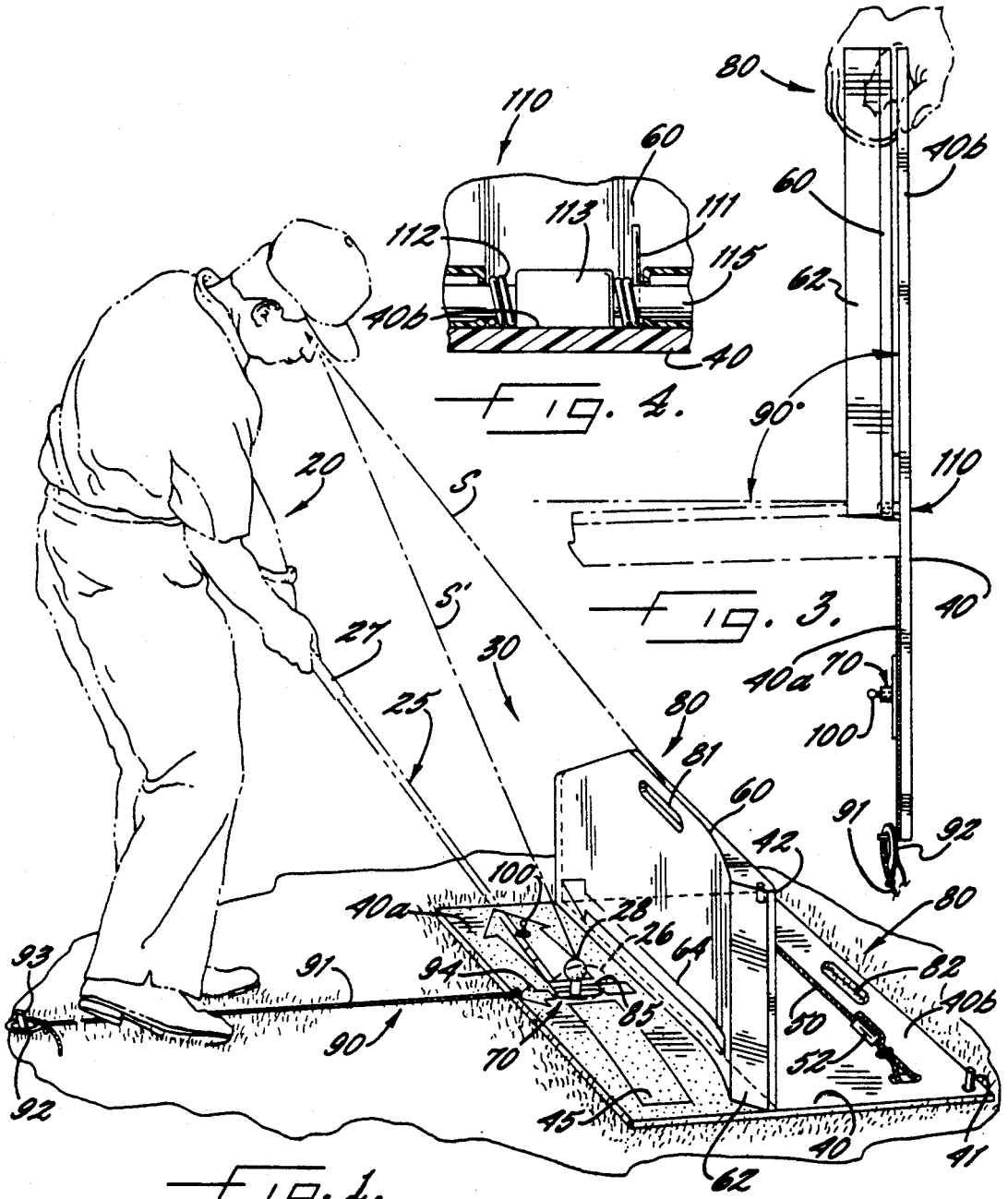
Fig. 4.
Fig. 3.
Fig. 1.
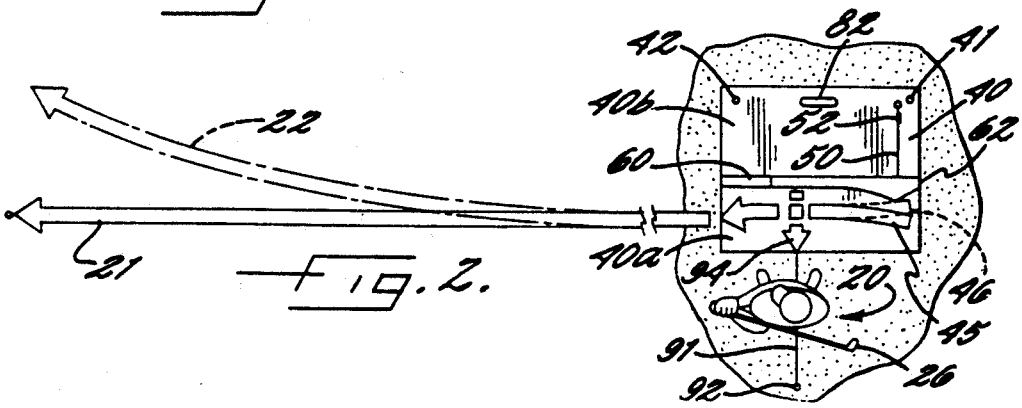
Fig. 2.

Fig. 5.
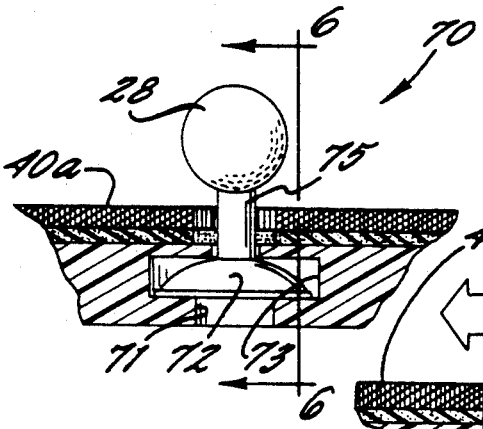
Fig. 6.
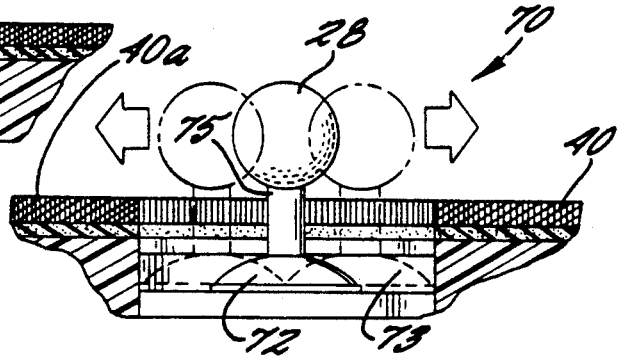
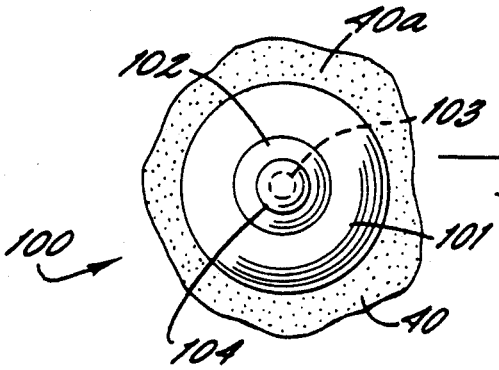
Fig. 7.
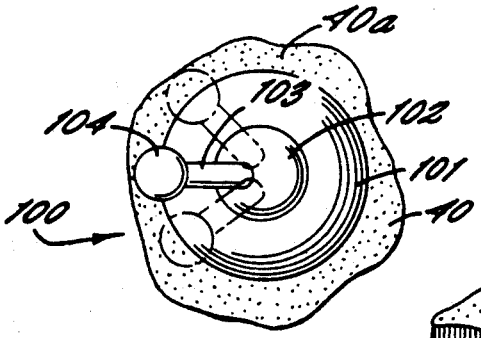
Fig. 8.
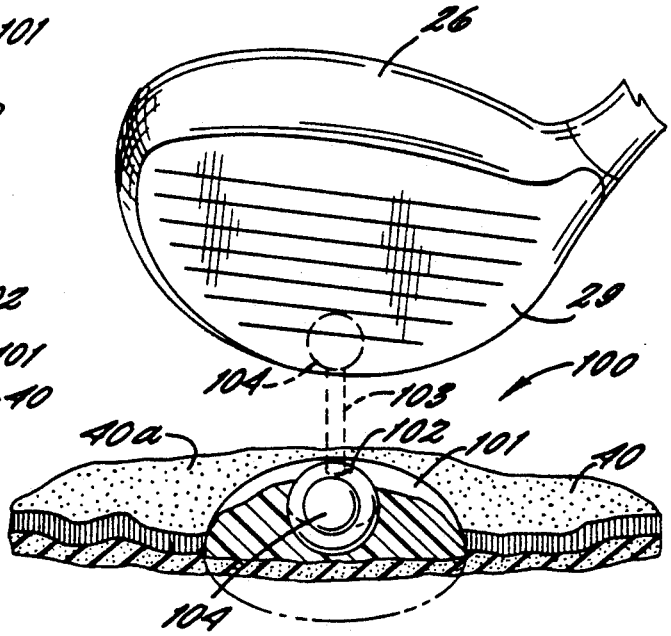
Fig. 9.

GOLF APPARATUS FOR CORRECTING A GOLFER'S SLICE

FIELD OF THE INVENTION

This invention related to golf equipment, and more particularly to an apparatus for correcting the slice put on a ball when it by a golfer.

BACKGROUND OF THE INVENTION

Generally, golfers place a ball on a tee, swing a golf club in an arcing motion with respect to their bodies and strike the ball with the head of a golf club. If the club face and the ball do not connect in a flush manner, the ball will either deviate to the left to from a hook or deviate to the right to form a slice with respect to a horizontal and perpendicular plane to the golfer.

Various attempts have been made to try to analyze a golfer's swing for these deviations from a straight path when the ball is not hit flush. These devices typically provide feedback to the golfer on the direction of the flight of the ball when the club head strikes it. Examples of such devices may be seen in U.S. Pat. No. 4,889,341 by Walker entitled "Golf Swing Analyzer", U.S. Pat. NO. 3,408,076 by Carboni entitled "Golf Swing Indicator", U.S. Pat. No. 3,113,780 by Livingstone entitled "Golf Practice-Swing Device", and U.S. Pat. No. 3,081,109 by Starck entitled "Sport Practice Device."

To correct a golfer's improper swing, other devices have been developed which create a path or put guide posts along the ground for directing the direction of the swing before striking the ball. Examples of these devices may be seen in U.S. Pat. No. 4,465,281 by Whitfield entitled "Golf Practice Mat", United Kingdom Patent Application 2,066,083 by Abel & Imray entitled "Golf Training Aid", and France Patent 2,614,544 by Chapman entitled "Ball Simulator For Golf Swing Practice." These devices, however, require the golfer to some show physically guide his swing through the guide posts or along the designated path to hit the ball. Also, other devices have been developed, such as seen in U.S. Pat. No. 3,994,501 by O'Donnell entitled "Golf Swing Practice Device", which provide feedback on weight shifts for the golfer as he swings to hit the ball.

Further, some devices have been developed which provide a wall for guiding the golfer's swing. Such devices may be seen in United Kingdom Patent 504,154 by Chapman entitled "Apparatus For Practicing Golf Strokes" and U.S. Pat. No. 3,753,563 by Previte, Jr. entitled "Golf Practice Device." These wall devices, however, fail to provide adequate height for the walls, angular and pivotal adjustments for the wall, flexibility when the golf club strikes the wall instead of the ball, or physical and mental limitations for guiding the club head when striking the ball.

Therefore, there is a continual need for an apparatus that corrects a golfer's swing by mentally inhibiting an improper swing and by providing flexibility if the golf club fails to properly strike the ball.

SUMMARY OF THE INVENTION

It is an object of the present invention to provide a golf apparatus that guides a golfer's swing into the correct position to prevent a slice.

These and other objects and advantages of the invention are provided by a golf apparatus for correcting a golfer's slice that has a tee for mounting a golf ball thereon adjacent the ground and a swing guide in the form of a vertical wall member of a sufficient height above the ground so as to produce an optical illusion from the eye level perspective of a user of the golf apparatus that the swing guide is closer to the golfer than in reality to thereby encourage the user to swing a golf club in a proper stroke toward a golf ball mounted on the tee. The swing guide is tapered from an enlarged end positioned toward the start of a golfer's swing to the other end to provide guidance for the swing path of the golfer's club. The swing guide may be pivotally adjusted to various annular positions with respect to the horizontal plane of the ground and flexibly collapses if the golfer strikes the swing guide instead of the ball. When the swing guide wall member collapses, it will then strikingly resume a predetermined angular position and thereby prevent damage to the golfer or the golf club.

More particularly, the golf apparatus has a tee for mounting a golf ball thereon adjacent the ground and a swing guide vertically oriented with respect to the ground when the golf apparatus is in use. The swing guide is angularly adjustable and pivotable with respect to the ground and the tee for guiding a golfer's swing so as to correct the golfer's tenancy to slice the golf ball. The golf apparatus also has means in the form of springs for biasing the swing guide toward its vertically oriented position even if the swing guide is struck and pivoted by a golf club.

DESCRIPTION OF THE DRAWINGS

Some of the objects and advantages of the present invention having been stated, others will become apparent as the description proceeds when taken in conjunction with the accompanying drawings, in which:

FIG. 1 is an environmental view of the golf apparatus according to the present invention and a golfer striking the golf ball mounted on the tee;

FIG. 2 is a top environmental view illustrating a golfer having hit the ball, a flight path of the ball when hit in a relatively straight direction, and a phantom view indicating the slice if the ball was not hit with an inside-to-square swing;

FIG. 3 is a side view of the golf apparatus according to the present invention with the swing guide in a collapsed position and illustrating the raised position in a phantom view;

FIG. 4 is an enlarged cross sectional view of a spring and hinge connecting the swing guide to the base member according to the present invention;

FIG. 5 is a cross sectional view of the adjustable tee connected to the base member according to the present invention;

FIG. 6 is a cross sectional view of the adjustable tee and the base member taken along line 6—6 to illustrate the adjustable position of the tee with the respect to the swing guide;

FIG. 7 is a top view of the swing detector engaging the horizontal base member with parts broken away for clarity;

FIG. 8 illustrates the movement of the swing detector as shown in FIG. 7; and FIG. 9 is a cross sectional view of the swing detector illustrating the head of a golf club in the follow through or finish of the swing when striking the swing detector according to the present invention.

DETAILED DESCRIPTION OF A PREFERRED EMBODIMENT

The present invention now will be described more fully hereinafter with reference to the accompanying drawings in which a preferred embodiment of the invention is shown. This invention may, however, be embodied in may different forms and should not be construed as limited to the embodiment set forth herein; rather, this embodiment is provided so that this disclosure will be thorough and complete, and will fully convey the scope of the invention to those skilled in the art. Like numbers refer to like elements throughout.

FIGS. 1 and 2 illustrate the use of the golf apparatus 30 for correcting a golfer's slice according to the present invention. FIG. 1 depicts a golfer 20 striking the golf ball 28 with the head 26 of a golf club 25 and with a generally inside-to-square swing when using the golf apparatus 30. The golf apparatus 30 has a base member 40, having for 40*a* and a second 40*b* ends, a swing guide in the form of a vertical wall member 60, typically formed of a polymeric material, and a tee 70 adjacent the ground or connected to the base member 40. The base member 40 is secured to the ground or other golfing surface by pegs 41, 42 through openings in the second end 40*b*. The swing guide, or herein the vertical wall member 60, generally has a height of about a foot or more, 13 inches in this embodiment. The swing guide, or herein the vertical wall member 60, must be of sufficient height above the ground so as to produce an optical illusion from the eye level perspective of a user of the golf apparatus that the swing guide is closer to the golfer than in reality to thereby encourage the user to swing a golf club 25 in a proper stroke toward the golf ball 28 mounted on the tee 70. The vertical wall member 60 mentally inhibits the golfer's swing toward an inside-to-square swing path because the height of the vertical wall member 60 gives the optical illusion from the eye level of the golfer 20 that vertical wall member 60 is closer than it really is. This optical illusion of depth of the swing generally indicated by the dashed lines S and S′ as viewed from the perspective at the golfer's eye level thereby causes the golfer 20 to mentally and physically adjust a previously poor swing form thereby correcting a tendency to slice the ball. By providing the vertical wall member 60 with a height of about a foot or more, the golfer 20 hesitates swinging the golf club 25 in a swing path that causes the ball to slice.

Also, the vertical position of the vertical wall member 60 with respect to the base member 40 may be adjustable by use of a cord 50 having an adjustable cord guide member 52. The adjustable cord guide member 52 flexibly holds the vertical wall member 60 at various angular positions with respect to the base member 40. The cord 50 and the cord guide member 52 allow the vertical wall member 60 to springingly collapse when the golfer 20 strikes the vertical wall member 60. The collapsed or partially collapsed vertical wall member 60 then pivotally resumes the predetermined angular position set for the vertical wall member 60 by the golfer's use of the cord 50 and the cord guide member 52.

The first end 40*a* of the base member 40 and the vertically adjustable vertical wall member 60 also have swing directional arrows 45, 64 fixedly attached thereto. These directional arrows 45, 64 are generally located so as to face the golfer 20. The swing directional arrows 45, 64 point in the desired direction of the object of the golf shot or location for hitting the ball 28. The directional arrows 45, 64, along with the golfer alignment indicator 90 adjacent the tee 70, also generally orient the golfer 20 for properly aligning his golf shot and provide proper alignment or set for positioning the golfer 20 to hit the shot. The golfer alignment indicator 90 has a cord member 91 and a ring member 92 attached to an end of the core member 91. A peg 93 or the like secures the ring member 92 to the ground or golfing surface and is generally positioned in perpendicular out-stretched direction with respect to the vertical wall member 60.

The vertical wall member 60 also has an enlarged end 62 for being positioned toward the start of a golfer's swing and which preferably is tapered or contoured therefrom so as to guide the swing of a golf club 25 toward a golf ball 28 mounted on the tee 70. If the golfer 20 fails to make a proper inside-to-square swing, then the club head 26 will typically strike the enlarged end 62 of the vertical wall member 60. If the enlarged end 62 is hit with the golf club 25, then the vertical wall member 60 will pivotally collapse as described above. A means 110 having springs 111, 112 associated with the vertical wall member 60 and the base member 40, as shown in FIG. 4, bias the vertical wall member 60 toward its vertically oriented position to thereby allow the vertical wall member 60 to flexibly spring back into the predetermined angular and pivotal position, instead of maintaining a horizontal position, after the club 25 strikes the enlarged end 62. The springs 111, 112, are typically two way springs connected to a hinge 113.

In the top environment view, illustrated in FIG. 2, the correct or proper swing taken by the golfer 20 is shown by the darkened arrow 21 indicating the generally straight direction for the flight of the ball 28 after it is hit. The phantom view of the base of the arrow 46 on the first end 40*a* of the base member 40 and near the enlarged end 62 of the vertical wall member 60 illustrates that an improper swing would cause the golf club 25 to strike the enlarged end 62 as described above. The phantom view of arrow 22 indicates the slice that is placed on a golf ball 28 if the golf apparatus 30 is not used, if the golf apparatus 30 is used improperly, if the vertical wall member 60 is not used, or if the golfer 20 strikes the vertical wall member 60 with an outside swing path. The golf apparatus 30 thereby corrects the golfer's tendency to slice the ball 28 by physically and mentally inhibiting the swing path in order to guide the club 25 so as to contact the ball 28 with a proper inside-to-square swing path.

FIGS. 3 and 4 illustrate the adjustment of the vertical wall member 60 with respect to the base member 40 and the holding, carrying capability, or portability of the golf apparatus 30. The side view shown in FIG. 3 illustrates the pivotal collapsibility of the vertical wall member 60 either after the enlarged end 62 is hit by the golf club 25 or for carrying the golf apparatus 30. A first hand slot or opening 81 in the vertical wall member 60 and a corresponding second hand slot or opening 82 in the second end 40*b* of the base member 40 separately and together form a handle 80 so that a user's hand can be inserted through openings 81, 82, when the base member 40 and the vertical wall member 60 are pivoted together. The handle 80 provides for adjusting, collapsing, or carrying the golf apparatus 30 as illustrated by the phantom view of the hand in FIG. 3. This view also illustrates the adjustable angular and pivotal displacement of the vertical wall member 60 with respect to the base member 40 or the ground. As illustrated, the vertical wall member 60 may extend beyond a 90 degree angle with respect to the base member 40 toward the golfer 20. This position further guides and enables the golfer to swing the club 25 in an inside-to-square direction with respect to the ball 28 and further mentally inhibits the golfer's swing.

FIG. 4 shows an enlarged view of the spring 111, 112 and hinge 113, 115 engagement of the vertical two-way spring 111, 112 allows the vertical wall member 60 to flexibly and resiliently springs back into the angularly and pivotally adjusted position after being struck by the golf club 25.

FIG. 5-9 further illustrate the construction of various parts of the golf apparatus 30, with FIGS. 5 and 6 illustrating the construction of the tee 70 and FIGS. 7-9 illustrating the construction of the swing detector 100. FIG. 5 is a side cross-sectional view of the tee 70, typically formed of rubber, connected to the base member 40. The tee 70 is typically adjustable and has a base portion 72 and a stem portion 75 adjustably guided through an opening in the first end 40*a* of the base member 40 by plate mating members 71, 73. As shown in FIG. 6, the base plate 72 and the tee stem 75 slidably adjust in a direction generally perpendicular to the raised vertical wall member 60. The phantom views illustrate this movement with respect to the golfer 20 and the vertical wall member 60. The position of the adjustable tee 70 may vary depending on the size of the golf club 25 and its distance from the vertical wall member 60, the particularly golf club 25 used, and the placement or alignment of the golfer 20 with respect to the golf apparatus 30.

FIG. 7 is a top view of a swing detector 100 connected to the first end 40*a* of the base member 40 adjacent the tee 70 beyond the point at which the golf club 25 would contact the golf ball 28 in finishing a swing path toward, over, and past the tee 70. The swing detector 100 has a socket base member 101 attached to the first end 40*a* of the base member 40, as further illustrated in FIG. 9. A pivotal base member 102 engages the socket base member 101 and thereby pivots within the socket base member 102. The swing detector 100 also has a swing detector stem 103 attached to the pivot base member 102 and, in turn, a ball member 104 attached to the swing detector stem 103.

As further illustrated in FIGS. 8 and 9, the swing detector 100 pivots within the socket base member 101 by a pivotal base member 102 when a club face 29 of the golf club head 26 strikes the ball member 104 in the swing follow-through or finish after hitting the ball 28. As the club face 29 strikes the ball member 104, the pivotal base 102 will pivot and the ball member 104 will point in the direction of the swing follow-through or finish. The directional club travel in the finish of the swing after striking the ball 28 will then be indicated by the relative position of the ball member 104 and swing detector stem 103 of the swing detector 100.

In the drawings and specification, there have been disclosed typical preferred embodiments of the invention and, although specific terms are employed, they are used in a generic and descriptive sense only and not for the purpose of limitation, the scope of the invention being set forth in the following claims.

That which is claimed is:

1. A golf apparatus for correcting a golfer's slice when hitting a golf ball, comprising:

a support surface, a tee on said support surface, for mounting a golf ball thereon; and a horizontally elongated wall forming a swing guide adjacent said tee when vertically oriented with respect to said support surface when said golf apparatus is in use, said swing guide extending upward from said support surface a distance significantly greater than the height of said tee so as to produce an optical illusion from the eye level perspective of a user of said golf apparatus that said swing guide is closer to the golfer than in reality to thereby encourage the user to swing a golf club in a proper stroke toward a golf ball mounted on said tee, means for angularly adjusting and pivoting said swing guide with respect to said support surface and to said tee for guiding a golfer's swing so as to correct the golfer's tendency to slice the golf ball; and means associated with said pivotable swing guide for biasing said swing guide toward its vertically oriented position even if said swing guide is struck and pivoted by a golf club.

2. A golf apparatus according to claim 1, wherein said swing guide comprises a vertical wall member having an enlarged end for being positioned toward the start of a golfer's swing and being tapered therefrom so as to guide the swing of a golf club toward a golf ball mounted on said tee.

3. A golf apparatus according to claim 2, further comprising a handle for holding or carrying said golf apparatus.

4. A golf apparatus according to claim 3, wherein said handle comprises an opening in an end of said vertical wall member.

5. A golf apparatus according to claim 1, wherein said biasing means comprises a spring.

6. A golf apparatus according to claim 1, further comprising swing detecting means for being connected to said tee beyond the point at which a golf club would contact a golf ball on said tee in finishing a swing path toward, over, and past the tee.

7. A golf apparatus according to claim 1, wherein said tee is adjustable in a generally perpendicular direction toward or away from said swing guide.

8. A golf apparatus according to claim 1, further comprising means adjacent to said tee and said swing guide for properly aligning a golfer with respect to said golf apparatus for a golf shot.

9. A golf apparatus according to claim 8, wherein said alignment means comprises a directional arrow and a cord adjacent said tee and generally perpendicular to said swing guide for providing proper golfer alignment and directional indication for a golf shot.

10. A golf apparatus according to claim 8, wherein said alignment means further comprises directional arrows on said support surface and said swing guide for aligning said golf apparatus for a golf shot.

11. A golf apparatus according to claim 1, wherein said swing guide is adapted to be secured to the ground.

12. A golf apparatus according to claim 1, wherein said tee is formed of rubber and said swing guide is formed of a polymeric material.

13. A golf apparatus according to claim 1, wherein said tee is adjustable in a generally perpendicular direction toward or away from said swing guide, said adjustable tee having at base portion and a stem portion for mounting a golf ball thereon, said base portion being slideably engageable with said base member.

14. A golf apparatus according to claim 1, wherein said swing guide has a height of about a foot or more.

* * * * *

UNITED STATES PATENT AND TRADEMARK OFFICE

CERTIFICATE OF CORRECTION

PATENT NO. : 5,224,709

DATED : July 6, 1993

INVENTOR(S) : Marvin C. Buck, Jr.

It is certified that error appears in the above-identified patent and that said Letters Patent is hereby corrected as shown below:

Column 1, line 6, "related" should be -- relates --.

Column 1, line 15, "from" should be -- form --.

Column 1, line 28, "3,081,109" should be -- 3,018,109 --.

Column 1, line 39, "some show" should be -- somehow --.

Column 2, line 11, "annular" should be -- angular --.

Column 2, line 16, "strikingly" should be -- springingly --.

Column 3, line 20, "for" should be -- first --.

Column 3, line 41, "of" should be -- for --.

Column 4, line 4, after "set" insert -- up --.

UNITED STATES PATENT AND TRADEMARK OFFICE

CERTIFICATE OF CORRECTION

PATENT NO. : 5,224,709

DATED : July 6, 1993

INVENTOR(S) : Marvin C. Buck, Jr.

It is certified that error appears in the above-identified patent and that said Letters Patent is hereby corrected as shown below:

Column 4, line 31, after "environment" insert -- al --.

Column 5, line 8, after "vertical" add -- wall member 60 with respect to the base member 40. The --

Column 5, line 29, after "particular" delete -- ly -.

Column 5, line 61, after "purpose" add -- s --.

Column 6, line 38, "the" should be -- said --.

Column 6, line 63, "at" should be -- a --.

Signed and Sealed this

Twenty-fifth Day of January, 1994

Bruce Lehman

*Attest:*

BRUCE LEHMAN

*Attesting Officer*

*Commissioner of Patents and Trademarks*